US005359818A

United States Patent [19]

Costa

[11] Patent Number: 5,359,818

[45] Date of Patent: Nov. 1, 1994

[54] HAND TOOL AND METHODS OF CONSTRUCTING AND UTILIZING SAME

[75] Inventor: Jean L. Costa, Almont, Mich.

[73] Assignee: Covil Products, Inc., Almont, Mich.

[21] Appl. No.: 166,263

[22] Filed: Dec. 10, 1993

Related U.S. Application Data

[63] Continuation of Ser. No. 822,974, Jan. 21, 1992, abandoned.

[51] Int. Cl.[5] ..... B24D 15/00

[52] U.S. Cl. ..... 451/492; 81/177.1; 81/489; 451/493; 451/512; 451/515; 451/524

[58] Field of Search ..... 51/358, 359, 360, 361, 51/378, 379, 380, 381, 383, 388, 392, 393; 81/177.1, 489

[56] References Cited

U.S. PATENT DOCUMENTS

| | | | |
|---|---|---|---|
| D. 37,998 | 5/1906 | Tower | 81/489 |
| 1,181,123 | 5/1916 | Edenborough | 51/383 |
| 1,968,215 | 7/1934 | McNaught | 51/381 |
| 2,290,098 | 7/1942 | Field . | |
| 2,430,060 | 11/1947 | Lamb | 51/392 |
| 2,507,017 | 5/1950 | Jenkins | 51/381 |
| 3,171,724 | 3/1965 | Nichols . | |
| 3,972,161 | 8/1976 | Zoiss . | |
| 4,339,896 | 7/1982 | Dennis et al. . | |
| 4,934,024 | 6/1990 | Sexton | 81/489 |

*Primary Examiner*—Jack Lavinder
*Attorney, Agent, or Firm*—Irving M. Weiner; Joseph P. Carrier; Pamela S. Burt

[57] ABSTRACT

A hand tool for the use in sanding, polishing or finishing of articles of manufacture including wood, plastic and metal articles. A length of abrasive material, such as sandpaper or emery cloth, is secured to the tool with a portion of the length of abrasive material retained in a storage area. The abrasive material is secured to an extended blade which may be sized and shaped as required. The blade may include ridges or nodules to retain the abrasive material in position on the blade while the tool is being used. A securing member slides over the blade and the abrasive material to frictionally secure the abrasive material to the tool. As required, new abrasive material may be pulled from the storage portion and secured to the blade.

20 Claims, 2 Drawing Sheets

FIG. 1
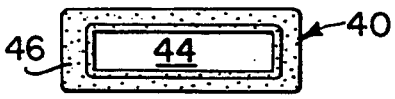
FIG. 2
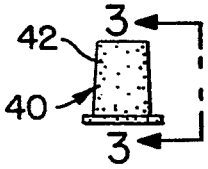
FIG. 3
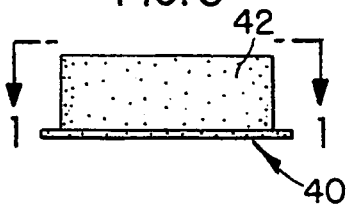
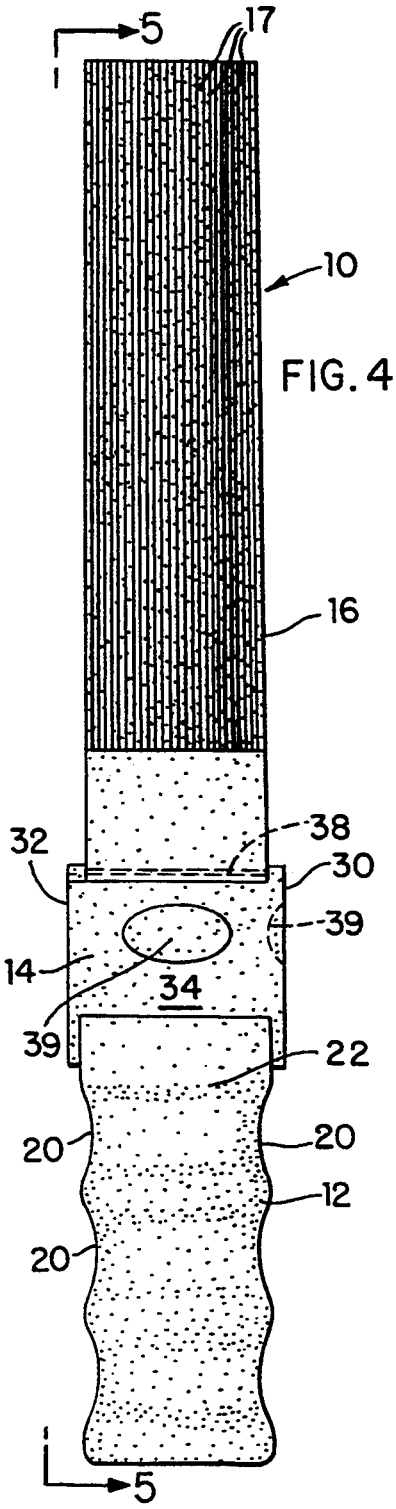
FIG. 4
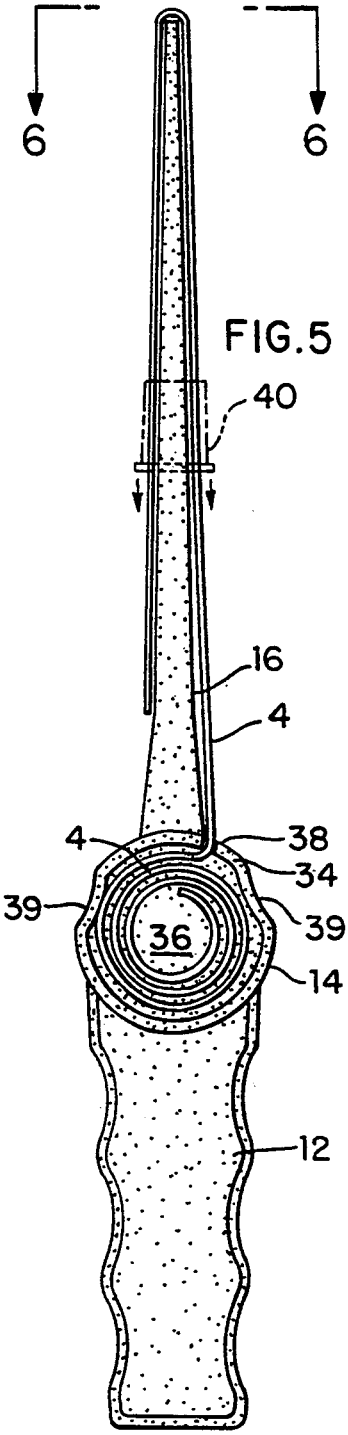
FIG. 5
FIG. 6
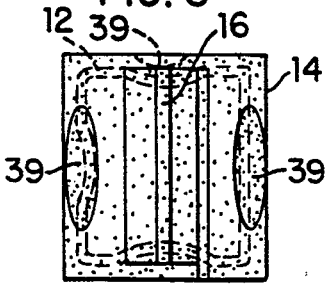
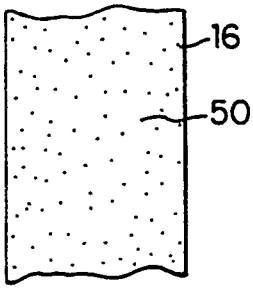
FIG. 7

FIG. 8
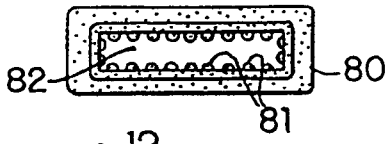
FIG. 9
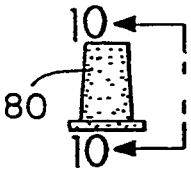
FIG. 10
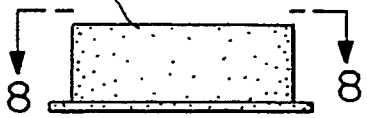
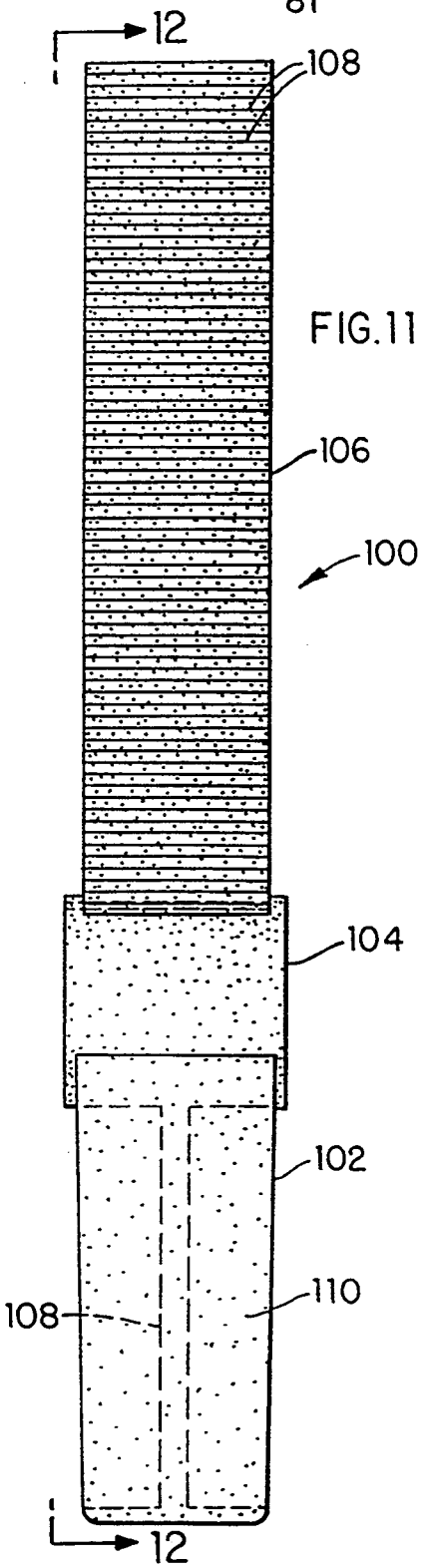
FIG. 11
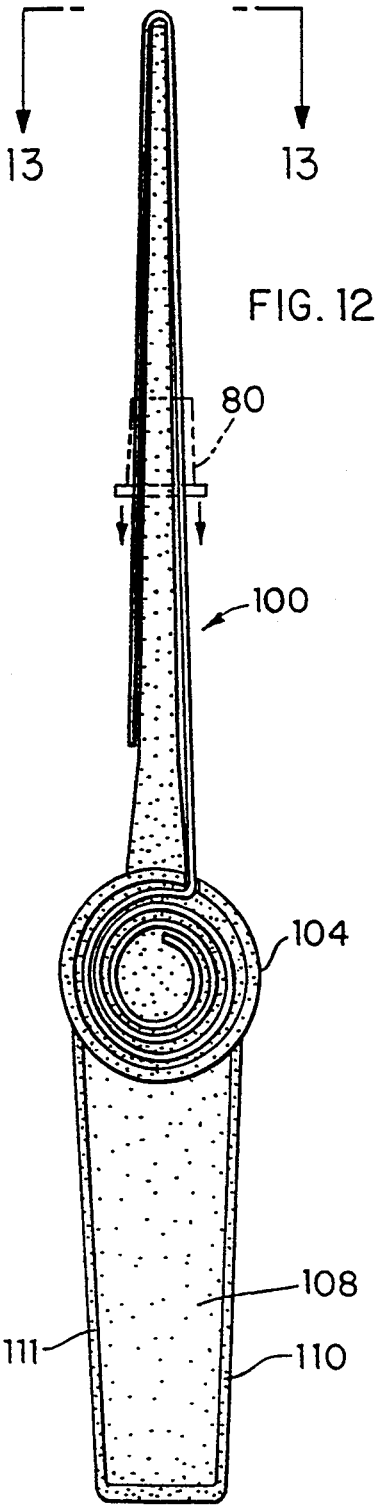
FIG. 12

HAND TOOL AND METHODS OF CONSTRUCTING AND UTILIZING SAME

This is a continuation of application Ser. No. 07/822,974, filed Jan. 21, 1992 now abandoned.

BACKGROUND OF THE INVENTION

Field of the Invention

The present invention relates to a hand held tool adapted to retain a length of sandpaper or emery cloth for finishing, smoothing or polishing an article of manufacture.

In the manufacture of articles, it is often necessary to remove unwanted material or to sand off material to provide a proper finish on the article. Often, especially on wooden articles of manufacture, numerous curves and turns make areas inaccessible to normal sanding and polishing techniques employing a sanding block.

The present invention overcomes the shortcomings of the previous methods and techniques by providing a hand tool apparatus which retains a length of abrasive material upon an extending blade. The abrasive material secured to the blade is then used on the article of manufacture. When needed, an unused portion of the length of material may be advanced onto the blade for use. The blade may be shaped to suit a particular situation or article.

The terminology "working material" employed herein is intended to connote any of a variety of abrasive, honing, grinding or polishing materials used for surface polishing, honing, grinding, sanding or finishing on an article of manufacture, including but not limited to sandpaper and emery cloth. Typically, such sandpaper consists of paper covered on one side with abrasive material (such as sand) glued thereon and used for smoothing and polishing. Emery cloth consists of a cloth covered with a clark granular mineral that consists essentially of corundum which is used for grinding and polishing.

It is often necessary to remove unneeded and unwanted portions from an article of manufacture. This includes wood, metal and plastic injection molded articles of manufacture. This is often accomplished with sandpaper or emery cloth to provide a finished appearance.

Description of the Relevant Art

Prior to the present invention, there have been various methods and tools for sanding, polishing or smoothing articles of manufacture. The most basic tool would comprise a block of wood having sandpaper held or secured thereon.

U.S. Pat. No. 3,171,724 discloses a tooling comprising a block of abrasive material secured to a handle. The block of material includes alternating layers of fiberglass and foam glass slabs.

U.S. Pat. No. 2,290,098 discloses a tool including a length of material wound into a cone and secured to mandrel. The mandrel includes a shank securable to a lathe or drill chuck and a threaded cone for securing the length of material wound into a cone.

U.S. Pat. No. 4,339,896 discloses a tool for dressing a grinding wheel comprised of bonded diamond crystals and tungsten carbide.

U.S. Pat. No. 3,972,161 discloses a tool consisting of abrading elements in the form of elongated fibers of selected harder material transverse to the work face of the tool.

Each of the above-discussed tools have a shortcoming which is overcome by the present invention. The present invention effectively overcomes such shortcomings by providing a comfortable, convertible hand tool usable with or without a rotary tool turning the article of manufacture.

SUMMARY OF THE INVENTION

The present invention may suitably comprise, consist of, or consist essentially of a handle portion, a winding compartment, a blade and means for securing a length of abrasive material to the blade. The blade may include means for retaining the length of abrasive material in position on the blade. The handle may include finger indentations to permit the user to easily grasp the tool and apply the correct or suitable pressure onto the article of manufacture. In a preferred embodiment, finger indentations are provided on each side of the winding compartment.

It is an object of the present invention to provide a tool which securely holds lengths of abrasive material thereon.

It is a further object of the present invention to provide an improved tool capable of sanding and polishing.

It is a further object of the present invention to provide an improved tool which enhances and improves the finishing process.

It is a still further object of the present invention to provide an improved tool including a supply of abrasive material.

The above and further objects, details and advantages of the invention will become apparent from the following detailed description when read in conjunction with the accompanying drawings.

BRIEF DESCRIPTION OF THE DRAWINGS

FIG. 1 illustrates a top planar view of a portion of a tool in accordance with the present invention.

FIG. 2 illustrates an end view of the portion of the tool shown in FIG. 1.

FIG. 3 illustrates a side view as shown by line 3—3 in FIG. 2.

FIG. 4 illustrates a front view of a tool in accordance with the present invention.

FIG. 5 illustrates a side view of a tool in accordance with the present invention taken along line 5—5 of FIG. 4.

FIG. 6 illustrates a top view of a tool in accordance with the present invention taken along line 6—6 of FIG. 5.

FIG. 7 illustrates a second embodiment of a portion of the tool blade in accordance with the present invention.

FIG. 8–12 illustrate a third embodiment of a tool in accordance with the present invention.

DETAILED DESCRIPTION OF THE PREFERRED EMBODIMENTS

Referring now to the drawings, and more particularly to FIGS. 4–6 thereof, a hand tool 10 for use in the sanding, polishing and/or finishing of an article of manufacture is shown. FIGS. 1–3 illustrate a top, a side and an end view of a securing means 40.

Referring now to FIG. 4, the tool 10 preferably comprises a handle portion 12, an abrasive material storage portion 14 and a blade member 16. Handle 12 accommodates a user's fingers by having preferably, but not necessarily, indentations 20 to facilitate holding the tool 10. The handle 12 may preferably, but not necessarily, also be "textured" to facilitate the user holding the tool 12, even in moist or oily conditions. The texture preferably resembles a toughened outer surface.

The abrasive material storage portion 14 is integral with a second end of the handle portion 12. Portion 14 is preferably, but not necessarily, drum-shaped or substantially cylindrical with a closed end 30, an open end 32 and a side wall 34. As best seen in FIG. 5, open end 32 permits access to a winding compartment 36 into which a portion of the abrasive material 4 is stored in a wound state. The side wall 34 includes a slot 38 through which the abrasive material 4 passes, the slot 38 being adjacent the blade 16 for the abrasive material 4 to be held on the blade 16 as described below. Storage portion 14 preferably, but not necessarily, additionally includes at least one thumb depression 39 for the user to provide sufficient pressure on the blade 16 and abrasive material when the tool 10 is in use. Preferably, two depressions 39 are provided in the side wall 34 as best seen in FIG. 5. In addition, a depression 39 may be provided in end wall 30 shown in phantom in FIG. 4.

As best seen in FIG. 5, the abrasive material 4 extends along one side of blade 16, over the distal end thereof and along the other side of blade 16 at least to storage portion 14. The material 4 is secured in this position by securing means 40 comprising a substantially rectangular securing member 42 having a central aperture 44 and a flange 46 which projects outwardly around one end of the member.

Blade 16 is preferably, but not necessarily, tapered having a thick or large end adjacent the storage portion 14 and a thinner distal end. As shown in FIG. 5 the thick end of the blade immediately adjacent the storage portion 14 tapers outwardly at a greater angle from a longitudinal axis of the blade than does the remainder of the blade. Blade 16 retains the abrasive material 4 for use in a sanding or polishing job on an article of manufacture. For example, a wood article turned on a lathe may have several knurls or rounded edges which may be difficult to sand by hand. However, the present invention permits the article to be left on a lathe and the abrasive material 4 positioned in the desired locations by blade 16. The securing member 42 is also tapered, as shown in FIGS. 2 and 5, for cooperating with the thick end of the tapered blade 16.

Blade 16 may preferably, but not necessarily, include means for retaining the abrasive material 4 in position comprising a series of ridges 17 as seen in FIG. 4 extending the length of the blade 16. The retaining means 17 may also comprise a series of irregular or discontinuous nodules or bumps 50 on the blade as seen in FIG. 7. Optionally, blade 16 may preferably, but not necessarily, include both forms of retaining means as shown in FIG. 4 with the irregular modules 50 at the thick or large end of blade 16 where securing means 40 would normally frictionally lock to secure the abrasive material.

In use, the tool 10 may preferably, but not necessarily, be used to sand or polish articles of manufacture either through hand sanding or utilizing a rotary machine for turning the article and applying the abrasive material thereto with the tool 10. In addition, the blade 16 may preferably, but not necessarily, be sized and shaped to accommodate a particular article. Such modifications would include the rounding of the corners of the blade 16, the shortening of the blade 16 or decreasing the width of the blade 16.

FIGS. 8–12 illustrate a third embodiment 100 of the tool of the present invention. FIGS. 8–10 illustrate a securing means 80 similar to securing means 40 described above. A significant difference is the addition of irregular nodules 81 on the inside of the central opening 82 for additional clamping securement of the abrasive material.

The tool 100 shown in FIGS. 11 and 12 comprises substantially similar components including a handle portion 102, a storage portion 104 and a blade portion 106. Blade portion 106 preferably, but not necessarily, includes a series of ridges 108 which traverse the width of the blade to aid in retaining the abrasive material in position on the blade 106 during use. This embodiment of tool 100 lacks the finger indentations on handle 102 and thumb indentations on storage portion 104. The handle 102 comprises preferably, but not necessarily, a web of material 108 indented from the outer handle portions 110, 111.

The present invention is characterized by extreme simplicity, economy of manufacture, durability and convenience of use. Its uncomplicated nature, its compactness, and its ready attachability and removal from the tool of the abrasive material render the invention practical where much of the prior art has proven impractical.

Although there has been described what is at present considered to be preferred embodiments of the invention, it will be understood that various modifications and variations may be made therein, and it is intended to cover in the appended claims all such modifications as fall within the true spirit and scope of the invention.

I claim:

1. A hand tool, comprising:

a handle portion adapted to be grasped by a user's hand;

an abrasive material storage portion disposed at one end of said handle portion;

a blade member extending from said storage portion tapering from a larger portion adjacent said storage portion to a distal end; and means for securing a length of abrasive material on said blade member;

said handle portion, said storage portion and said blade member being formed as an integral, unitary member;

said securing means comprising a tapered securing member having a central opening of a size to pass said blade member therethrough;

said tapered securing member and said larger portion of said tapered blade member being adapted to frictionally lock ends of the length of abrasive material therebetween; and said larger portion of said blade member being tapered to a greater degree than is said distal end of said blade member.

2. The hand tool of claim 1, wherein:

said storage portion is drum-shaped with an open end, a closed end and a slot adjacent to and parallel with said blade member.

3. The hand tool of claim 2, wherein:

said blade member includes means for retaining said length of abrasive material in a proper position thereon.

4. The hand tool of claim 3, wherein:

said means for retaining comprises a plurality of parallel ridges on surfaces of at least said distal end of said blade member.

5. The hand tool of claim 4, wherein:

said means for retaining further comprises a plurality of discontinuous nodules on surfaces of said larger portion.

6. The hand tool of claim 1, wherein:

said handle portion includes indentations to accommodate the fingers of a user's hand.

7. The hand tool of claim 1, wherein:

said storage portion includes a plurality of depressions thereon to accommodate the thumb of a user's hand.

8. The hand tool of claim 1, wherein:

said blade member is adapted to be cut to a size and shape to accommodate a use on a desired article of manufacture.

9. A hand tool according to claim 1, wherein said storage portion includes at least one depression thereon to accommodate the thumb of a user's hand.

10. A hand tool according to claim 1, wherein said tapered member has a plurality of nodules projecting into said central opening from an inner surface thereof for additional clamping securement of said length of abrasive material.

11. A hand tool for use in sanding, polishing and finishing of articles, comprising:

a handle portion having a first end and a second end;

a substantially cylindrical storage portion with a closed end, an open end and a circular side wall, such storage portion being integral with said second end of said handle portion;

a blade member extending integrally from said storage portion side wall and having a thick first end tapering to a thinner distal end; and means for securing a length of abrasive material to said blade member such that a user gripping said handle portion can manipulate said length of abrasive material to sand, polish and finish an article;

said storage portion side wall having a slot therein adjacent said blade member first end and adapted to have said length of abrasive material pass therethrough;

said securing means comprising a tapered member with a central aperture sized to accommodate said blade member and said length of abrasive material;

said tapered member being adapted to cooperate with said thick first end of said blade member to frictionally lock said length of abrasive material therebetween; and said thick first end of said blade member is tapered to a greater degree than is said thinner distal end of said blade member.

12. The hand tool of claim 11, wherein:

said storage portion comprising a cylindrical compartment in which a wound length of abrasive material may be retained until needed.

13. The hand tool of claim 11, wherein:

said blade member includes a plurality of ridges thereon.

14. The hand tool of claim 11, wherein:

said blade member is adapted to be be sized and shaped as desired to accommodate sanding, polishing or finishing procedure.

15. A hand tool according to claim 11, wherein said storage portion includes at least one depression thereon to accommodate the thumb of a user's hand.

16. A hand tool according to claim 11, wherein said tapered securing member further includes a flange projecting outwardly around a larger end of said tapered securing member.

17. A tool, comprising:

first means for removably and selectively storing a length of working material;

second means forming a tool handle portion;

third means for selectively securing at least a first portion of said working material in an operable working position;

said first means, said second means, and at least part of said third means being formed as an integral unitary structure;

said third means including a tapered blade member, and movable means for increasing retention between said blade member and said first portion of said abrasive material;

said movable means comprises a tapered member having a central opening defined therethrough such that said tapered member can be slid over said blade member and said first portion of said abrasive material;

said tapered member being adapted to cooperate with said tapered blade member to frictionally lock said first portion of said abrasive material therebetween; and said blade member including first and second ends, said first end of said blade member being disposed adjacent said first means and being tapered to a greater degree than is the second end of said blade member.

18. A tool according to claim 17, wherein:

said third means further includes non-movable means for increasing retention between said blade member and at least a portion of said first portion of said working material; and said non-movable means comprising a plurality of discontinuous nodules.

19. A tool according to claim 17, wherein said first means comprises a hollow storage member having one open face, the storage member is adapted to selectively receive said length of abrasive material therein, and an outer surface of said storage member has at least one depression thereon to selectively accommodate the thumb of a user's hand.

20. A tool according to claim 17, wherein said tapered blade member includes first and second ends, said first end being disposed adjacent said first means, and said first end tapers outwardly at a greater angle from a longitudinal axis of said blade member than does said second end of the blade member.

* * * * *